US006276278B1

(12) United States Patent
Korpe

(10) Patent No.: US 6,276,278 B1
(45) Date of Patent: Aug. 21, 2001

(54) ARRANGEMENT FOR COMBATING AIR TARGETS

(75) Inventor: Lars Korpe, Gothenburg (SE)

(73) Assignee: Bofors AB, Karlskoga (CH)

( * ) Notice: Subject to any disclaimer, the term of this patent is extended or adjusted under 35 U.S.C. 154(b) by 0 days.

(21) Appl. No.: 09/051,015

(22) PCT Filed: Oct. 4, 1996

(86) PCT No.: PCT/SE96/01256

§ 371 Date: Jun. 23, 1998

§ 102(e) Date: Jun. 23, 1998

(87) PCT Pub. No.: WO97/13115

PCT Pub. Date: Apr. 10, 1997

(30) Foreign Application Priority Data

Oct. 5, 1995 (SE) ..... 9503446

(51) Int. Cl.[7] ..... F42B 12/00; F42B 12/32

(52) U.S. Cl. ..... 102/492; 102/496

(58) Field of Search ..... 102/494, 491, 102/492, 475, 211, 213, 495, 496

(56) References Cited

U.S. PATENT DOCUMENTS

| | | | | |
|---|---|---|---|---|
| 3,136,251 | | 6/1964 | Witow | 102/67 |
| 3,474,731 | * | 10/1969 | Thomanek | 102/476 |
| 3,565,009 | | 2/1971 | Allred et al. | 102/56 |
| 3,714,897 | * | 2/1973 | Parker | 102/475 |
| 3,815,504 | * | 6/1974 | Tieben | 102/496 |
| 3,877,376 | * | 4/1975 | Kupelian | 102/67 |
| 3,974,771 | * | 8/1976 | Thomanek | 102/67 |
| 4,160,415 | * | 7/1979 | Cole | 102/214 |
| 4,327,643 | * | 5/1982 | Barrios | 102/493 |
| 4,524,696 | * | 6/1985 | Altenau et al. | 102/491 |
| 4,625,647 | * | 12/1986 | Laures | 102/214 |
| 4,655,139 | | 4/1987 | Wilhelm | 102/494 |
| 4,768,440 | * | 9/1988 | Deneuville et al. | 102/495 |
| 4,848,239 | * | 7/1989 | Wilhelm | 102/492 |
| 5,003,885 | * | 4/1991 | Rudolf et al. | 102/494 |
| 5,182,418 | * | 1/1993 | Talley | 102/475 |
| 5,341,743 | * | 8/1994 | Redaud | 102/384 |
| 5,448,500 | * | 9/1995 | Bredy et al. | 102/384 |
| 5,932,833 | * | 8/1999 | Hammon et al. | 102/213 |

FOREIGN PATENT DOCUMENTS

| | | | | |
|---|---|---|---|---|
| 314092 | * | 5/1989 | (EP) | 102/475 |
| 2678723 | * | 1/1993 | (FR) | 102/475 |
| 1150914 | * | 5/1969 | (GB) | 102/494 |
| 50099 | * | 2/1990 | (JP) | 102/475 |

* cited by examiner

*Primary Examiner*—Peter M. Poon
*Assistant Examiner*—Son T. Nguyen
(74) *Attorney, Agent, or Firm*—Connolly Bove Lodge & Hutz

(57) ABSTRACT

A shell for combating air targets is provided. The shell comprises a proximity fuse with up to four seeking directions together with an explosive charge arranged in the shell. One or more fragment-forming casings are arranged in the shell. The fragment-forming casings are designed to have main directions of action aligned with the seeking directions of the proximity fuse. Therefore, on detonation of the explosive charge, the shell has ball sheaves aligned with the seeking directions.

7 Claims, 3 Drawing Sheets

ARRANGEMENT FOR COMBATING AIR TARGETS

BACKGROUND OF THE INVENTION

The present invention relates to a new type of shell intended to increase mainly the effective range of anti-aircraft cannon, in the case of all near misses, to the greatest possible extent by concentrating the fragments formed on detonation of the shell in the direction of the target. The invention involves more specifically a combination of a specially designed explosive-charged shell forming fragments on its detonation and a special type of proximity fuse intended to initiate the explosive charge when a target is detected. The detailed construction of the proximity fuse has nothing to do with the invention, however, the fact that it is available is a prerequisite for the invention. The purpose of the invention is therefore partly to increase the potential of the AA artillery for combating extremely difficult targets such as sea-skimmers etc. and partly to increase the effect of the individual shells on more conventional targets. Also, the purpose is to reduce the dependency of anti-aircraft cannon on entirely accurate range calculations which, in spite of the most modern technology available, can be difficult to achieve in the rapid combat sequences which are now involved in combating air targets. Furthermore the number of targets which are extremely difficult to combat in the form of autonomous guided or self-guiding weapon carriers with small external dimensions can be expected to increase in the future since the air force seeks to an ever increasing extent to be able to combat a selected target without having itself to enter the risk area around the target.

Naval and field barrel-type anti-aircraft weapons of today consist mainly of automatic cannons of 20–76 mm caliber and for these use is as a rule made of explosive-charged high-explosive shells or ball-type high-explosive shells which, at least in the larger 40–76 mm calibers, are usually equipped with proximity fuses for initiation in the case of near misses of the target. For direct hits on the target there are percussion initiation functions.

The generation of proximity fuses in general use today have an antenna pattern with relatively undefined omnidirectional seeking beams, and in the same way the fragments formed on the detonation of the high-explosive shells and ball-type high-explosive shells of today are scattered radially from them about their own longitudinal axis.

The advantage of a combination of the omnidirectional proximity fuse and the omnidirectional fragmentation shell is that, with this combination, there is no need to keep track of the rotational position of the shell which therefore simplifies the initiation system. It is therefore only necessary for the proximity fuse to have ascertained that the shell is sufficiently close to a target for initiation of the explosive to take place. The disadvantage, however, is that the energy of the explosive charge and of the fragments scattered on its detonation is scattered while turning and is therefore directed only to a limited extent towards the target. For a single 40 mm AA shell, this means that it must today be as close to the target as roughly 5 meters in order to ensure that the target is shot down. Considering the rapid targets of today, it will be absolutely clear that such a close hit picture requires extraordinarily accurate prediction.

SUMMARY OF THE INVENTION

The purpose of the present invention is to provide a method and an arrangement for effectively combating air targets with explosive-filled shells which are provided with proximity fuses, fired from anti-aircraft cannon, and rotate in the trajectory towards the target. In order to increase the effect of the shells on the target, the fragmentation of the previous generation of AA shells, which was distributed symmetrically around their own longitudinal axis, has been replaced by a directed fragmentation where the dynamic scatter direction of the explosive charge and of the fragments has been concentrated in one or more directions which coincide with the seeking direction or seeking directions of the proximity fuse. At the same time, omnidirectional proximity fuses of the conventional Doppler radar type which were used previously have been replaced by a newly developed proximity fuse, the special feature of which is that it has one to four clearly delimited seeking or radiation directions. This proximity fuse may be a socalled optronic proximity fuse, which is actually a laser proximity fuse. It may also be an IR proximity fuse or another direction-sensing proximity fuse with one or possibly a few specifically defined radiation directions aligned with the main direction or main directions of the fragmentation of the shell, which will is therefore produce a concentrated fragment sheaf in the direction of the target on detonation of the shell. The fact that the radiation direction or radiation directions of the proximity fuse is/are aligned with the fragmentation means of course that consideration has been given to the flying speed of the shell and its rotational speed and also to the reaction time of the proximity fuse and its initiation function interacting therewith.

Through this combination, a proximity fuse-initiated shell is capable of effectively combating air targets at up to three times the detonation range from the target of the older types of proximity fuse-initiated shells of the same caliber which they are intended to replace. A further advantage of the combination according to the invention is elimination of the problem which was inherent in earlier types of proximity fuse which, in the outer edge of their range area, had a tendency to trigger the detonation of the shells far too late, when they had already passed the target. As this misfunction was a direct consequence of the antenna pattern of the older types of proximity fuse, it was difficult to avoid it.

The complete shell designed according to the invention may of course also be combined with other functional steps such as time release, initiation on direct hit, miss destruction etc.

In the selection of dynamic main-action direction/main-action directions of the explosive charge and the fragments and with this the aligned radiation direction/radiation directions of the proximity fuse, there are a number of different alternatives. An alternative suitable for a proximity fuse with a single radiation direction is to arrange the main-action direction of the explosive charge and the radiation direction of the proximity fuse at an acute angle forwards in relation to the trajectory direction of the shell. As a result of the rotation of the shell, complete coverage is then obtained for a conical space extending in front of the shell and uniformly distributed around the axis of the trajectory of the shell. A corresponding part of the space will be scanned by the proximity fuse along a spiral path formed as the shell rotates. If on the other hand the seeking direction of the proximity fuse can form an angle which approaches a 90° angle with the projectile trajectory, the proximity fuse will scan the space around the projectile trajectory along a spiral path formed in a corresponding manner.

Lastly, should the proximity fuse be provided with a number of seeking arms, the scanning pattern becomes denser with a number of spiral paths which run into one another. In the case of proximity fuses with a number of seeking directions, the shell must of course also be provided with a number of dynamic fragmentation directions aligned therewith.

In an embodiment of the invention which is suitable for combating larger targets such as aircraft, the proximity fuse is made dependent on its rotation having indicated the target twice before the explosive charge is initiated. This alterative is based on a microprocessor coupled together with the proximity fuse, which has been programmed so that, during the first revolution of the shell in contact with a target, it can calculate the number of samples or contacts with the target in order that, during the second revolution, it can trigger the explosive charge after half the number of samples established during the first revolution. This procedure affords the maximum chance of total destruction of the target in the case of larger targets.

In the case of small targets, however, e.g. sea-skimmers, the microprocessor connected to the proximity fuse must be programmed to initiate the explosive charge already on the first target indication since the target is in this case so small that the shell might otherwise pass the target before the next target indication could take place.

It is of course a requirement that the proximity fuse does not initiate the explosive charge before the shell is within combat range even if it should detect the target within its seeking area much earlier. At least for the moment, however, the range of the proximity fuse should be the limiting factor in the great majority of cases.

The present invention thus relates to an explosive-filled shell which is preferably intended for combating air targets, fired in a trajectory towards the target by a barrel-type weapon and rotationally stabilized in the trajectory, and which is intended, when it is detonated, to scatter fragments in the direction of the target. The shell is also provided with a proximity fuse which initiates the detonation of the explosive when the target has been detected. The invention is characterized then by the combination of the proximity fuse being made direction-sensing and the casing of the shell which fragments on detonation of the explosive being given such a shape that its dynamic fragmentation formed on detonation of the explosive coincides with the seeking direction of the proximity fuse. In this way, a proximity fuse-initiated shell is provided with a greater range than previously, available in which the fragments from the detonation of the shell will always fall upon the detected target. Also an important feature of the invention is that the seeking direction of the proximity fuse forms an angle of 15–90° with the longitudinal axis of the shell and that it can have up to four different simultaneous seeking directions distributed evenly around the periphery of the shell.

BRIEF DESCRIPTION OF THE DRAWINGS

The invention, together with its other characteristics, is defined in the patent claims below and it will now be described further in conjunction with the attached figures, in which FIG. 3 shows an alternative with a shell having two seeking beams directed in opposite directions and main combating directions directed parallel therewith, while

DETAILED DESCRIPTION OF THE INVENTION

Figure 1:
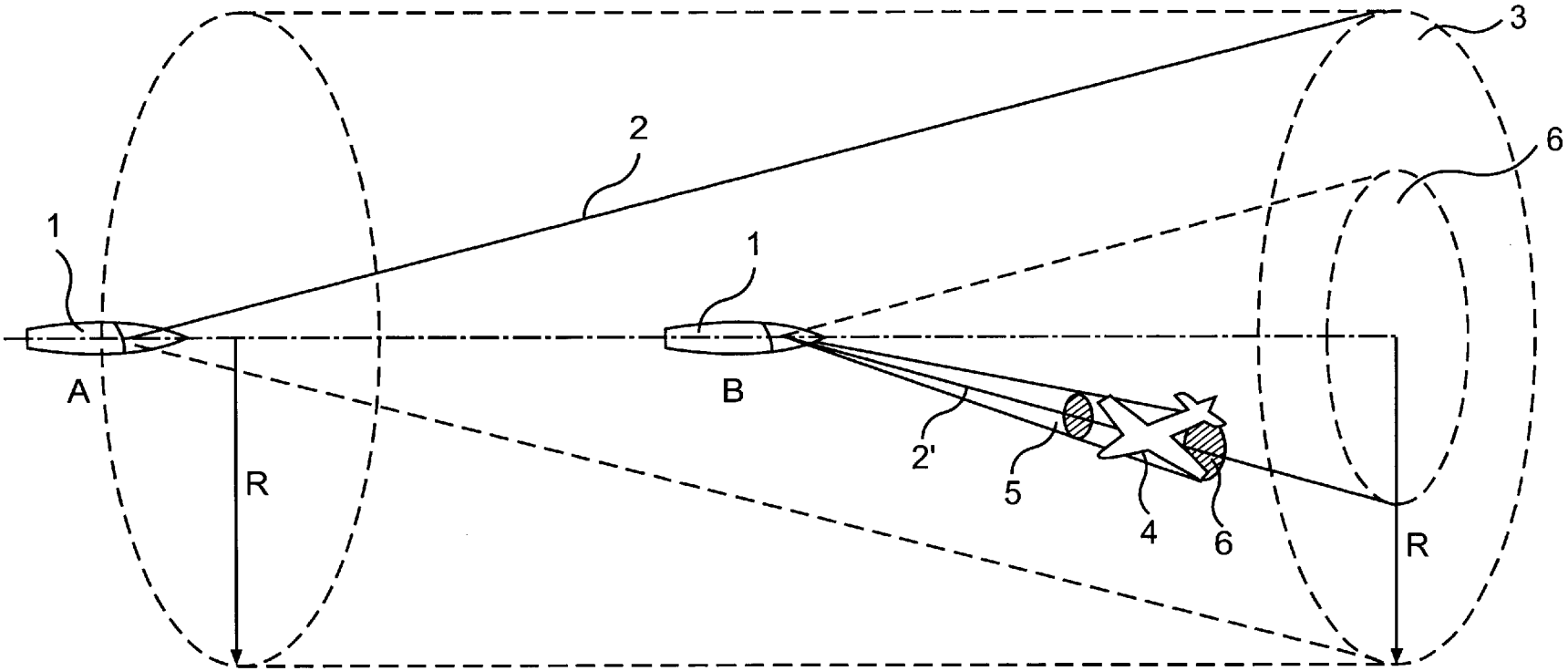
FIG. 1 shows one alternative embodiment of a shell provided with a proximity fuse with a seeking beam arranged obliquely forwards in the flight direction of the shell and, aligned therewith, a main combating direction for the active charge of the shell.

The shell 1 shown in FIG. 1 is located in the initial position A and the seeking beam 2 is directed obliquely upwards. Since the shell 1 rotates about its longitudinal axis, the seeking beam 2 will in principle enclose the cone which has the circular surface 3 as a base. This approach of course is simplified since the shell also moves forwards a little during a revolution. The length of the cone is not infinite either since its length is delimited by the range of the proximity fuse. If the position is not simply observed at a given moment, it would therefore probably be more correct to say that the successively scanned area consists of the space around the trajectory of the shell delimited by a radius R limited by the range of the proximity fuse. In this figure, a target 4 has been indicated. When the shell 1 has reached position B, the seeking beam 2 (designated as 2' in position B) strikes the target 4 and the explosive charge of the shell is initiated. Fragments which are emitted are scattered along the cone 5 marked in the figure and thus cover the target. That part of the surface 3 which the seeking beam 2' covers during an entire revolution on a level with position B has the base surface 6 in the figure. The lines 2 and 2' actually mark, for greater clarity, the dynamic scatter direction of the fragments rather than the actual seeking direction of the proximity fuse since these two directions, as a result of the rotation and speed of the shell and the reaction time of the initiation system will require a number of degrees at the side of one another.

Figure 2:
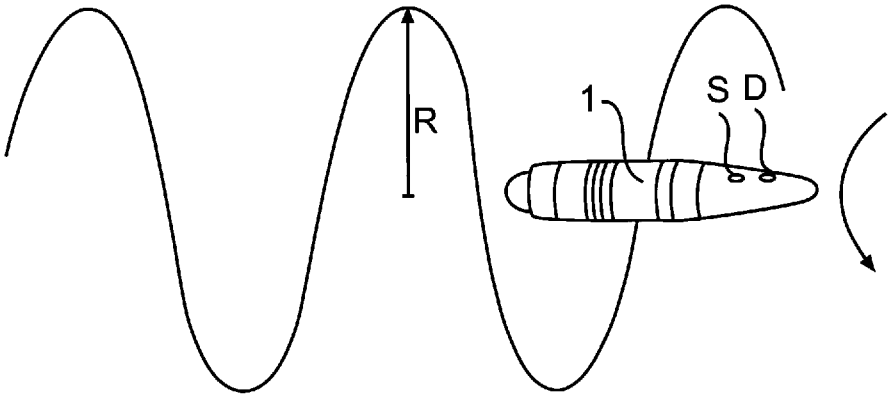
FIG. 2 shows another method of illustrating the scanning technique according to the invention.

In FIG. 2, which represents another method of the scanning by the shell 1 of the space around is around it, that part of the surrounding space which the shell covers has been marked by the spiral curve which the radius R covers as a result of the rotation of the shell 1. Also shown in FIG. 2 are the output lens 8 of the sensor belonging to the proximity fuse and the input lens d of the detector which interacts with the sensor.

Figure 3:
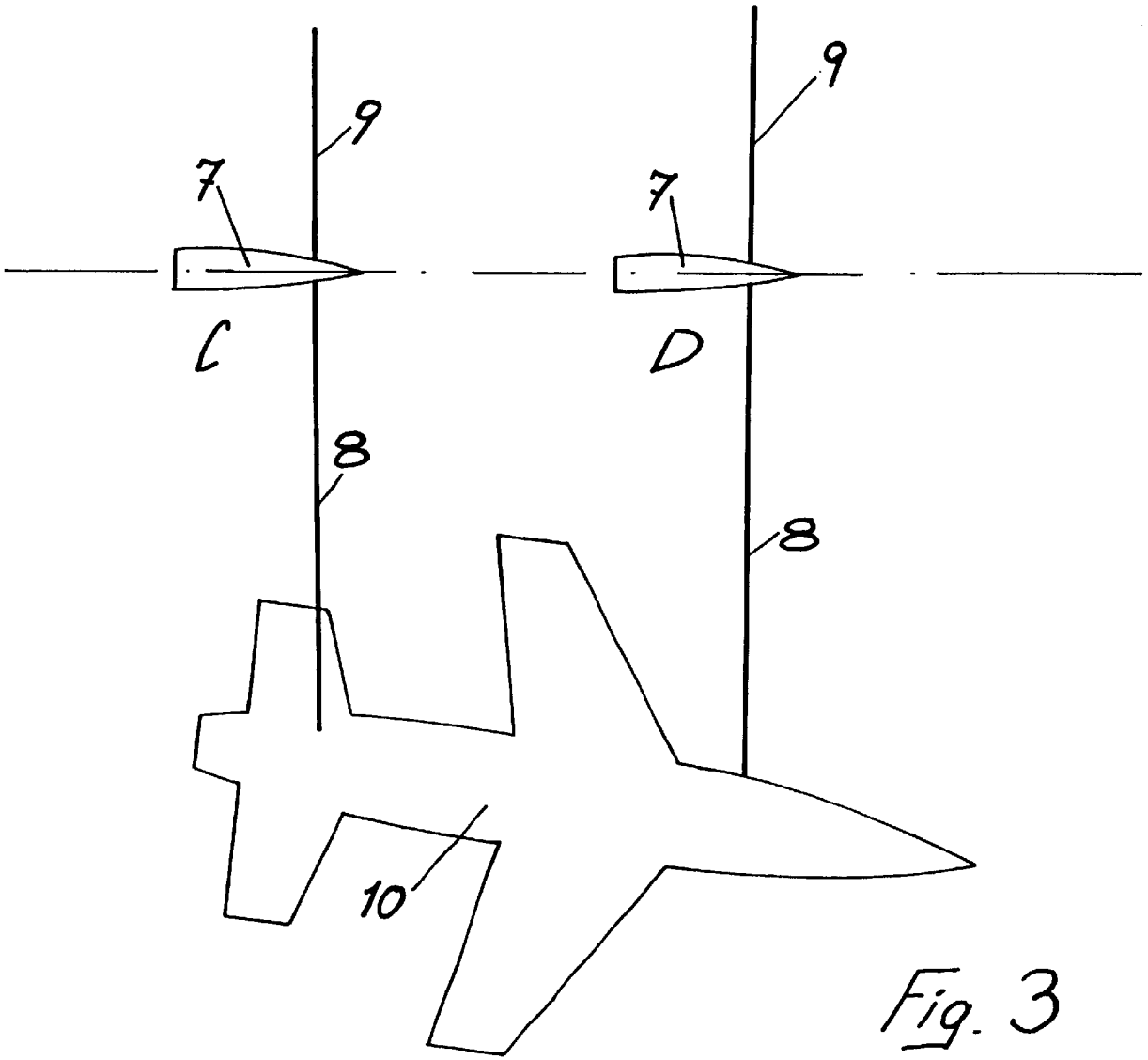

FIGS. 1, 2 and 3 involve obvious simplifications of the actual situation in that the dynamic fragmentation will never correspond to the normal to the fragmentation casing since both the projectile speed and the detonation of the explosive influence the direction of movement of the fragments. On the other hand, the seeking directions of the proximity fuse are correctly drawn in FIGS. 4 and 5 and it can be seen from these figures that the angular difference between the seeking directions and the respective fragmentation casing normal must be taken into account.

The shell 7 shown in FIG. 3 has two seeking directions for its own proximity fuse designated by 8 and 9 in the figure. The two main combating directions of the shell 7 have, as indicated above, for the sake of simplicity, been drawn here also as if they coincided entirely with the directions of the seeking beams. It has been possible to effect this simplification since it in this case, the shell no way affects the principle of the invention but only its execution in practice. In position C, the seeking beam 8 of the proximity fuse indicates a target 10. The shell, however, is programmed for larger targets, as a result of which no initiation of its explosive charge takes place. During its first revolution in contact with the target, the processor of the shell linked to the proximity fuse indicates two samples, in other words the contact of the seeking beams 8 and 9 with the target. In position D, which corresponds to the position another half revolution later, in other words one revolution after the first contact with the target 10, the explosive charge of the shell 7 is initiated since all indications during one revolution together with a further half the number of indications during a subsequent revolution is considered to be a certain target indication. In this case, the shell is assumed to be constructed in such a manner that it scatters fragments in two directions, on the one hand directly towards the target and on the other hand in the opposite direction. Other shell variants within the given inventive concept are of course also possible. If the shell has only one seeking beam and is programmed for large targets, then its detonation is initiated on the second target indication of the sensor within two consecutive revolutions.

Figure 4:
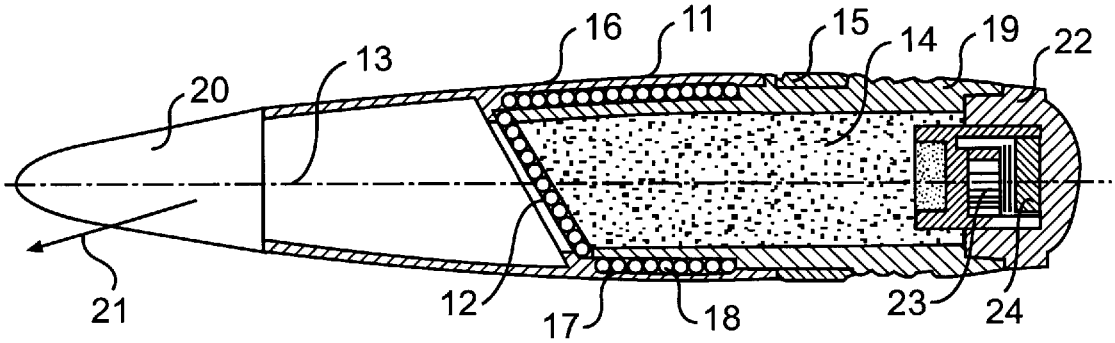
FIGS. 4 and 5 show different embodiments of shells according to the invention.

FIG. 4 shows a longitudinal section through an AA shell 11 comprising a forwardly directed active part 12 in the form of a fragmentation plate, which is at an angle with respect to the longitudinal axis of the shell and behind which an explosive charge 14 is arranged. The part of the cylindrical part of the shell 11 which lies behind the fragmentation plate 12 but in front of the band 15 of the shell is designed as a conventional ball-type high-explosive shell with a large number of steel or heavy metal Fragments 18 arranged between an outer and an inner casing wall 16 and 17 respectively (in this case in the form of heavy metal balls). The rear part 19 of the shell 11 on the other hand is made of a stronger material in order to function as a barrier in the formation of a concentrated fragment sheaf in the direction which covers the corresponding seeking direction of the proximity fuse arranged in the front part of the shell, here designated by 20, the seeking direction being indicated by 21. Apart from the seeking direction, no details of the proximity fuse 20 have been included in the figure. The initiation function 23 and the battery 24 necessary for the operation of the proximity fuse 20 are arranged in the rear part 22 of the shell 11.

Figure 5:
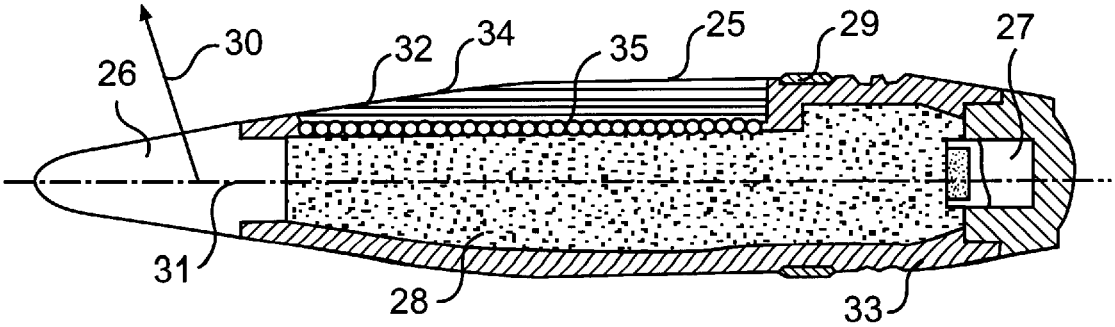

FIG. 5 shows a shell 25 which is designed to be of larger caliber than that in FIG. 4, for which reason the proximity fuse 26 and the initiation function 27 of the shell do not in this case occupy such a large part of the overall volume of the shell. The explosive charge of the shell is indicated by 28 and its band by 29. In this embodiment, the seeking direction of the proximity fuse is marked by the arrow 30 and inserted at the angle which covers the dynamic fragmentation direction of the fragmentation plate 32 which is in turn arranged parallel to the longitudinal axis 31 which coincides with its own trajectory direction. As can be seen from the figure, this alternative also gives a slightly forwardly directed direction of action. The fragmentation plate 32 extends from a position directly behind the mounting of the proximity fuse 26 in the tip of the shell to a position directly in front of the band 29 of the shell. This means that it has been possible to make the rear part 33 of the shell, similar to the embodiment in FIG. 4, sufficiently strong to withstand the stresses to which the shell will be exposed on its firing via a barrel intended for this purpose. Arranged between the fragmentation plate 32 and a special aerodynamically designed casing 34 which gives the shell its outer form is a filling material 35. This can also be used in order to balance the shell.

What is claimed is:

1. An explosive filled shell for barrel-type weapons, the shell being fired in a trajectory towards a target and being rotationally stabilized in the trajectory, the shell comprising:

an explosive charge arranged in the shell;

a proximity fuse for detonating the explosive charge when the target is detected, the proximity fuse having up to four seeking directions; and a fragment-forming casing placed adjacent to the explosive charge and having a main direction of action aligned with the seeking direction, the fragment forming casing comprising a fragmentation plate inclined relative to a longitudinal axis of the shell, on detonation of the explosive charge the fragment forming casing producing a dynamic fragmentation obliquely forwards in a flying direction of the shell.

2. A shell according to claim 1, wherein the seeking direction of the proximity fuse and the dynamic fragmentation direction form an angle of 15–90° with the trajectory of the shell.

3. The shell according to claim 1, wherein said fragmentation plate is formed from a large number of heavy metal fragments together.

4. A shell according to claim 3, further comprising side walls extending from outer edges of the fragmentation plate up to directly in front of a band of the shell, the side walls being made as a ball-type high-explosive shell with heavy metal fragments arranged between the walls.

5. The shell according to claim 1, wherein a separate fragment-forming casing is provided for each seeking directions.

6. The shell according to claim 1, further comprising:

a microprocessor coupled with the proximity fuse, a computer readable program code causing the microprocessor to, during a first revolution of the shell upon detection of a target, calculate a number of contacts with the target and during a second revolution of the shell, detonate the explosive charge upon half the number of contacts calculated during the first revolution.

7. The shell according to claim 1, wherein the proximity fuse has two seeking directions arranged 180 degrees opposite each other and two fragment forming casings each having their main direction of action aligned with one of the seeking directions.

* * * * *